US012111135B2

(12) United States Patent
Delany et al.

(10) Patent No.: US 12,111,135 B2
(45) Date of Patent: Oct. 8, 2024

(54) STOCK CHEEK RISER

(71) Applicant: GBRS Group, Virginia Beach, VA (US)

(72) Inventors: Evan Kenneth Delany, Fredericksburg, VA (US); Blair Cole Fackler, Virginia Beach, VA (US); Donald Wayne Shipley, III, Virginia Beach, VA (US); Slade William Cutrer, Virginia Beach, VA (US)

(73) Assignee: GBRS Group, Virginia Beach, VA (US)

( * ) Notice: Subject to any disclaimer, the term of this patent is extended or adjusted under 35 U.S.C. 154(b) by 0 days.

(21) Appl. No.: 17/898,215

(22) Filed: Aug. 29, 2022

(65) Prior Publication Data

US 2023/0068530 A1 Mar. 2, 2023

Related U.S. Application Data

(60) Provisional application No. 63/237,897, filed on Aug. 27, 2021.

(51) Int. Cl.

| | |
|---|---|
| ***F41C 23/14*** | (2006.01) |
| ***F41C 23/06*** | (2006.01) |
| ***F41C 23/18*** | (2006.01) |

(52) U.S. Cl.
CPC ..... *F41C 23/14* (2013.01); *F41C 23/06* (2013.01); *F41C 23/18* (2013.01)

(58) Field of Classification Search
CPC ..... F41C 23/14; F41C 23/06
See application file for complete search history.

(56) References Cited

U.S. PATENT DOCUMENTS

| | | | | |
|---|---|---|---|---|
| 8,341,867 | B2 | 1/2013 | Criswell | |
| D742,470 | S | 11/2015 | Battaglia | |
| D755,329 | S | 5/2016 | Kielsmeier et al. | |
| 9,488,435 | B1 | 11/2016 | Roberts et al. | |
| D788,252 | S | 5/2017 | Slater | |
| D823,979 | S | 7/2018 | Stevens | |
| D883,415 | S | 5/2020 | Noonan | |
| 11,644,272 | B1 | 5/2023 | Cutrer | |
| 11,656,057 | B2 * | 5/2023 | Levi | F41C 23/14 42/75.01 |
| 2007/0101631 | A1 | 5/2007 | Bentley | |
| 2011/0016764 | A1 | 1/2011 | Cales | |
| 2012/0110884 | A1 | 5/2012 | Riswell | |

(Continued)

FOREIGN PATENT DOCUMENTS

CN 211552611 U 9/2020

OTHER PUBLICATIONS

International Search Report mailed Apr. 21, 2023 issued in International Application No. PCT/US2022/041932.

(Continued)

*Primary Examiner* — J. Woodrow Eldred
(74) *Attorney, Agent, or Firm* — Eversheds Sutherland (US) LLP

(57) ABSTRACT

A stock cheek riser that includes two side walls connected by a hood, which form a channel for receiving a stock. The stock cheek riser is sized and its front face angled to provide sufficient room for manipulating a charging handle of the firearm to which the stock is attached, when the stock is in a collapsed position.

10 Claims, 5 Drawing Sheets

(56) References Cited

U.S. PATENT DOCUMENTS

| | | | | |
|---|---|---|---|---|
| 2017/0254614 | A1* | 9/2017 | Moretti | F41C 23/14 |
| 2023/0068530 | A1 | 3/2023 | Delany et al. | |
| 2023/0122203 | A1 | 4/2023 | Keller | |

OTHER PUBLICATIONS

Written Opinion of the International Searching Authority mailed Apr. 21, 2023 issued in International Application No. PCT/US2022/041932.

Notice of Allowance mailed Nov. 13, 2023 in corresponding Design U.S. Appl. No. 29/867,417.

* cited by examiner

STOCK CHEEK RISER

CROSS REFERENCE TO RELATED APPLICATIONS

This application is a non-provisional of and claims the priority benefit of U.S. App. No. 63/237,897 filed Aug. 27, 2021, the entire contents of which are hereby incorporated by reference herein.

FIELD OF THE DISCLOSURE

The disclosure generally relates to a stock of a firearm and more particularly relates to systems and methods for a stock cheek riser.

BACKGROUND

Conventional rifle stocks, such as those for the M4 rifles, fit on a buffer (or extension) tube at the breach end of the firearm. The stock, also referred to as a buttstock, may adjustable to different lengths but is not typically adjustable in height. Precisions rifle stock is known to be have adjustable cheek risers for providing the user with a cheek weld at a height desired by the user. However, precision rifle stock, typically used for long distance shooting, are expensive, heavy, not compatible with certain rifles when the cheek riser is installed, and as with any component with moving parts, is subject to failure.

In addition, cheek risers that may be added to an existing rifle stock are often configured to allow operation of the firearm when the stock is in an extended position, but not in the collapsed position. For instance, the charging handle may be unable to be properly actuated when the stock is in a collapsed position.

SUMMARY

Some or all of the above needs and/or problems may be addressed by certain embodiments of the stock cheek riser disclosed herein, which is of a unitary construction, and sized to allow the charging handle to be operated in the case of a malfunction when the stock is on a collapsed position.

Other features and aspects of cheek riser will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
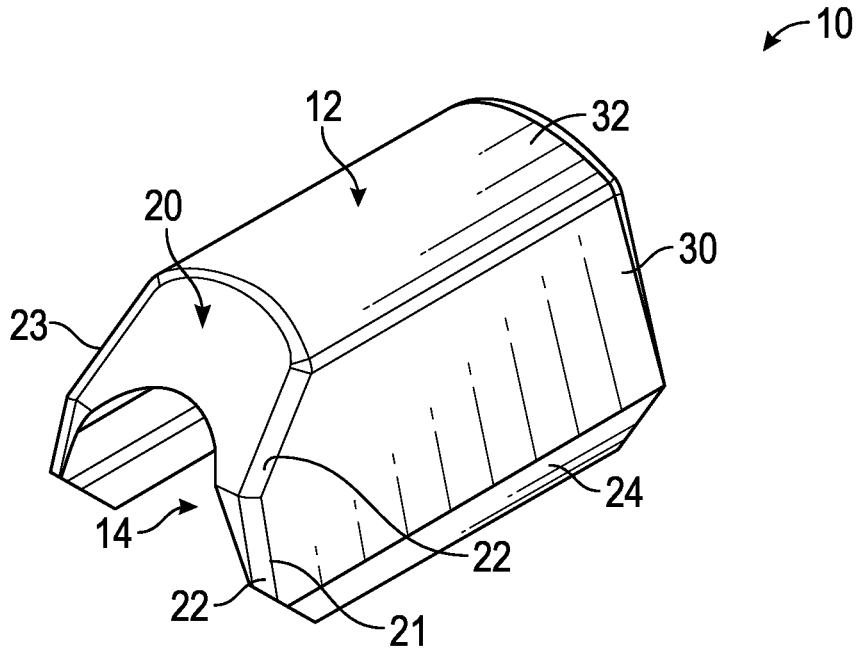
FIG. 1 depicts an upper perspective view of an exemplary stock cheek riser in accordance with one or more embodiments of the disclosure.
Figure 2:
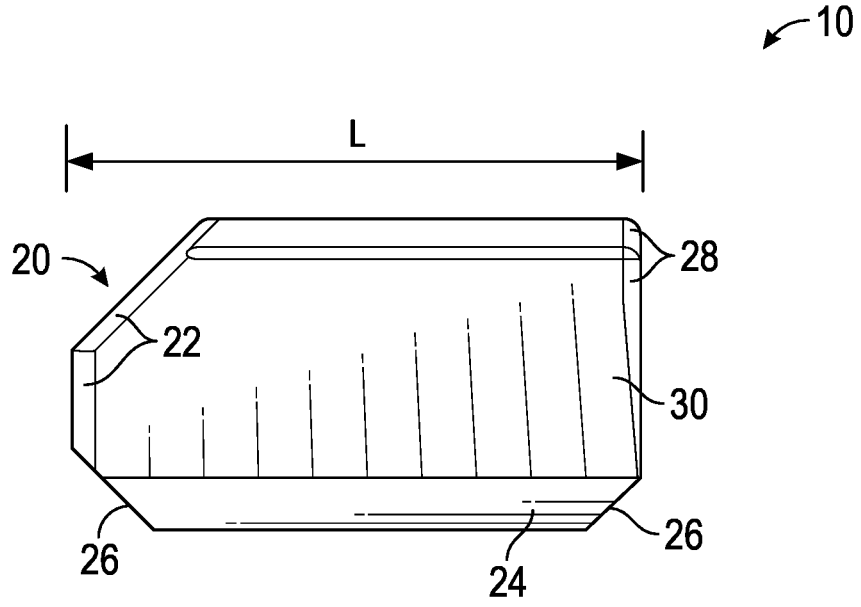
FIG. 2 depicts a side plan view of an exemplary stock cheek riser in accordance with one or more embodiments of the disclosure.
Figure 3:
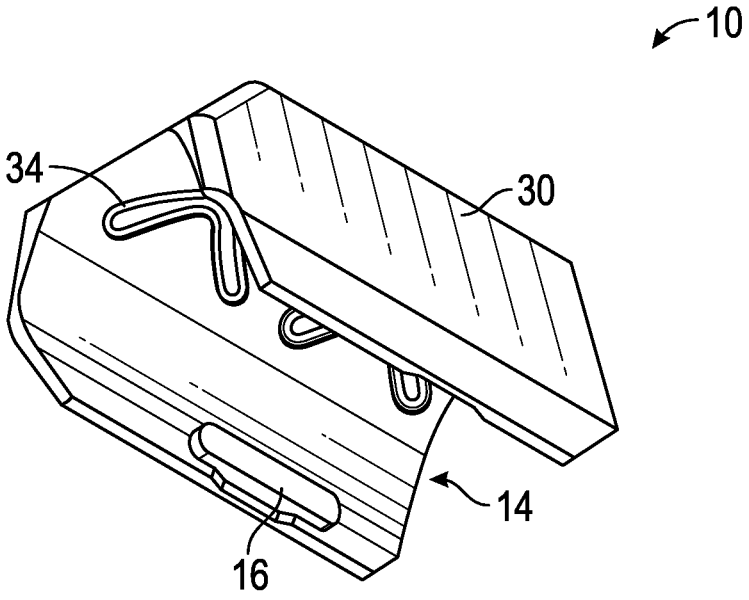
FIG. 3 depicts a lower perspective view of an exemplary stock cheek riser in accordance with one or more embodiments of the disclosure.
Figure 4:
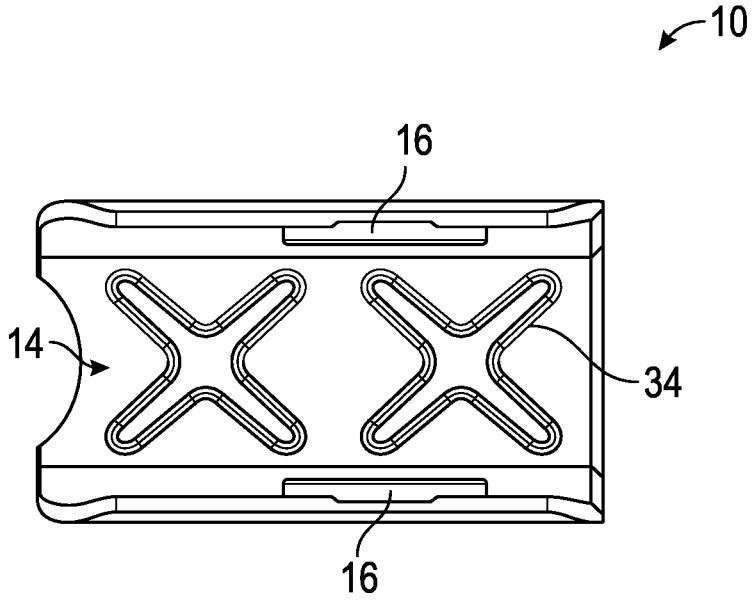
FIG. 4 depicts a bottom plan view of an exemplary stock cheek riser in accordance with one or more embodiments of the disclosure.
Figure 5:
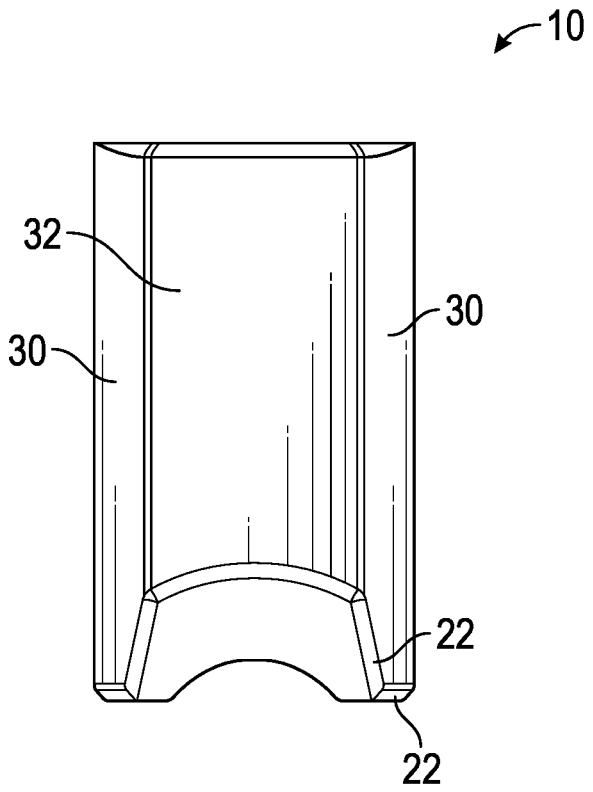
FIG. 5 depicts a top view of an exemplary stock cheek riser in accordance with one or more embodiments of the disclosure.

Described below are embodiments of a stock cheek riser that can be attached to a firearm, for example, a collapsible stock of a firearm. Methods of installing the stock cheek riser on the firearm are also disclosed. The firearm may include a barrel with a breech end and a muzzle end. In some instances, the firearm may be a rifle (e.g., fully automatic, semi-automatic or bolt-action), pistol, shotgun, or the like. In some instances, the firearm may be a rifle, such as an M-16 style rifle, an AR-15 style rifle, an AR-10 style rifle, or an M-4 style rifle, among others that include a buffer tube (also referred to as the receiver extension tube) to which a stock may be attached, for example, a collapsible stock that may be adjustable to position the stock at different positions along the buffer tube, ranging from a collapsed position where the stock is substantially adjacent to the receiver of the firearm, to an extended position where the stock is positioned at its furthest position form the receiver of the firearm.

A problem with existing stock risers on rifles with charging handles, such as an M-4 style rifle, is that when in the collapsed position of the stock the cheek riser impedes the operation of the charging handle, limiting the user's ability to fully retract the charging handle, such as to move the bolt carrier group in order to eject a round in the chamber or to chamber a new round from a magazine, or to execute malfunction protocols. In addition, cheek risers designed to attach to a stock often have edges and corners, usually at right angles, that tend to catch on other equipment of the user or impede or make more difficult the use of certain equipment, such as ear protection in the form of earmuffs, gasmask or night vision googles.

Another problem exists when a firearm is configured with an optic mount that is taller, say over 1.5 inches, which may provide the user with a more natural position when holding the firearm so as to improve operational movements, such as in close quarter combat. With a taller optic mount, the user's head is typically in a more upright and comfortable position, yet this will result in the stock being positioned lower on the user's face than desired, below the cheek bone, which is undesirable.

With reference to FIGS. 1-9, shown is an embodiment of a cheek riser 10 in accordance with the present disclosure. The riser 10 include a body 12 comprising side walls and a hood, which define a longitudinal channel 14 the length of the riser 10. Within the channel are two protrusions 16 opposing one another. The protrusions are elongated in shape and sized to fit within the side mounting slots found on a stock. See, for example, the MOE™ carbine stock sold by MAGPUL®. Thus, the riser 10 may be attached to a stock by placing the riser 10 over the stock so that the stock sits within the channel 14 and the protrusions 16 fit within the side mounting slots of the stock.

The riser 10 also include number chamfered edges, such as a front face 20. A lower portion 21 of the front face 20 is substantially perpendicular to the longitudinal axis of the channel 14, and an upper portion 23 of the front face is angled in the direction of the breech end of the firearm to provide additional room for the operation of the charging handle as well as to minimize undesirable interaction with other equipment of the user, such as slings, wires, earmuffs, gasmask, night vision googles, etc. Side edges 22 of the front face 20 and side edges 28 of the rear face are also chamfered to minimize the undesirable interaction, such as catching of a corner or edge, by a sling, wire, and earmuff.

Figure 6:
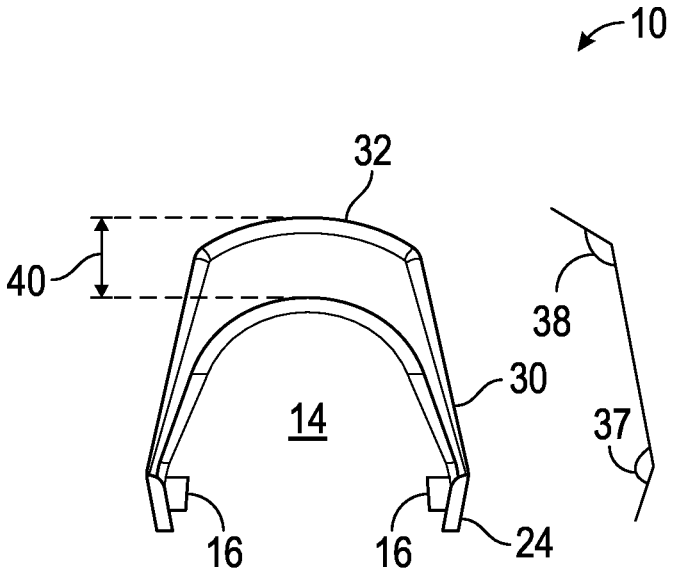
FIG. 6 depicts a front plan view of an exemplary stock cheek riser in accordance with one or more embodiments of the disclosure.
Figure 7:
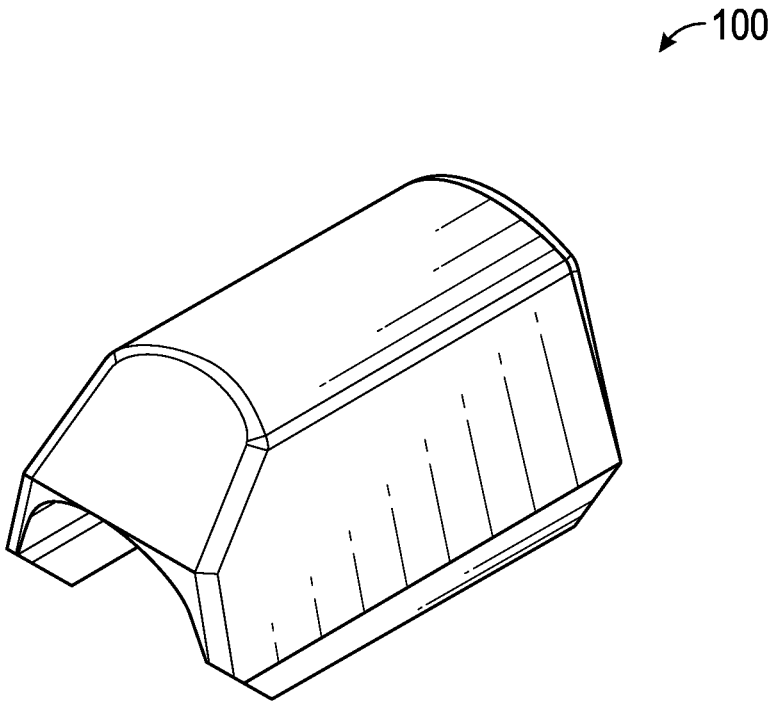
FIG. 7 depicts an upper perspective view of an alternative exemplary stock cheek riser in accordance with one or more embodiments of the disclosure.
Figure 8:
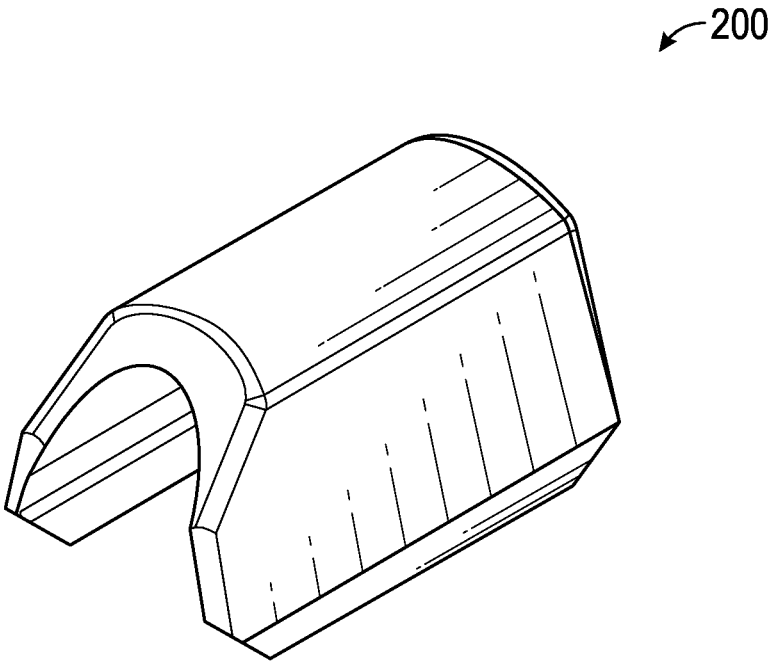
FIG. 8 depicts an upper perspective view of an alternative exemplary stock cheek riser in accordance with one or more embodiments of the disclosure.

In a similar fashion, a lower portion 24 of each side wall of the cheek riser 10 is angled in at an obtuse angle 37 relative to the side wall 30, as shown in FIG. 6, which further mitigates the chance of an undesirable interaction with another piece of equipment. Thus, the angle of the lower portions 24 are not parallel with their corresponding side walls 30, but rather. The lower edge surface 24 is also has an angled edge 26 at either end for similar reasons.

The riser 10 includes two angle side surfaces 30 connected by a rounded top surface or hood 32. The two surfaces 30 are angled inward, as shown in FIG. 6, and interface at an obtuse angle 38 with the hood 32 to minimize the transition angle, thereby minimizing the sharpness of the interface as that is part of the riser to which the user's face/cheek will be resting. The angle of the two sides wall is such that the plane of each side wall will intersect above the hood, whereas the plane of each lower portion of the side walls will intersect below the channel.

The rigidity of the riser 10 may be controlled by structural elements 34. The structural elements, shown in the shape of an "X" in the illustrated embodiment, but which may take other shapes, may include cuts or recesses into the body 12 to reduce weight or to increase pliability for installation and removal (e.g., increasing the flex between the side walls on opposite sides of the channel 14) or raised protrusions that increase rigidity that limit the flex between the side walls. Since the illustrative embodiment has 2 point for attaching to the stock, it is desirable to have the structural rigidity provided for by these structural elements as well as via the material used to make a rise of the present disclosure so that the riser 10 can be attached to a stock utilizing only the two rearward mounting slots furthest away from the receiver.

The riser may be designed to have any desired height, which height may be proportional to the height of the optic mount on the firearm, or to provide comfort of the user. Thus, the height 40 (FIG. 6) may vary, as shown by relatively taller riser 100 (FIG. 7) and a relatively shorter riser 200 (FIG. 8), as compared to riser 10.

Figure 9:
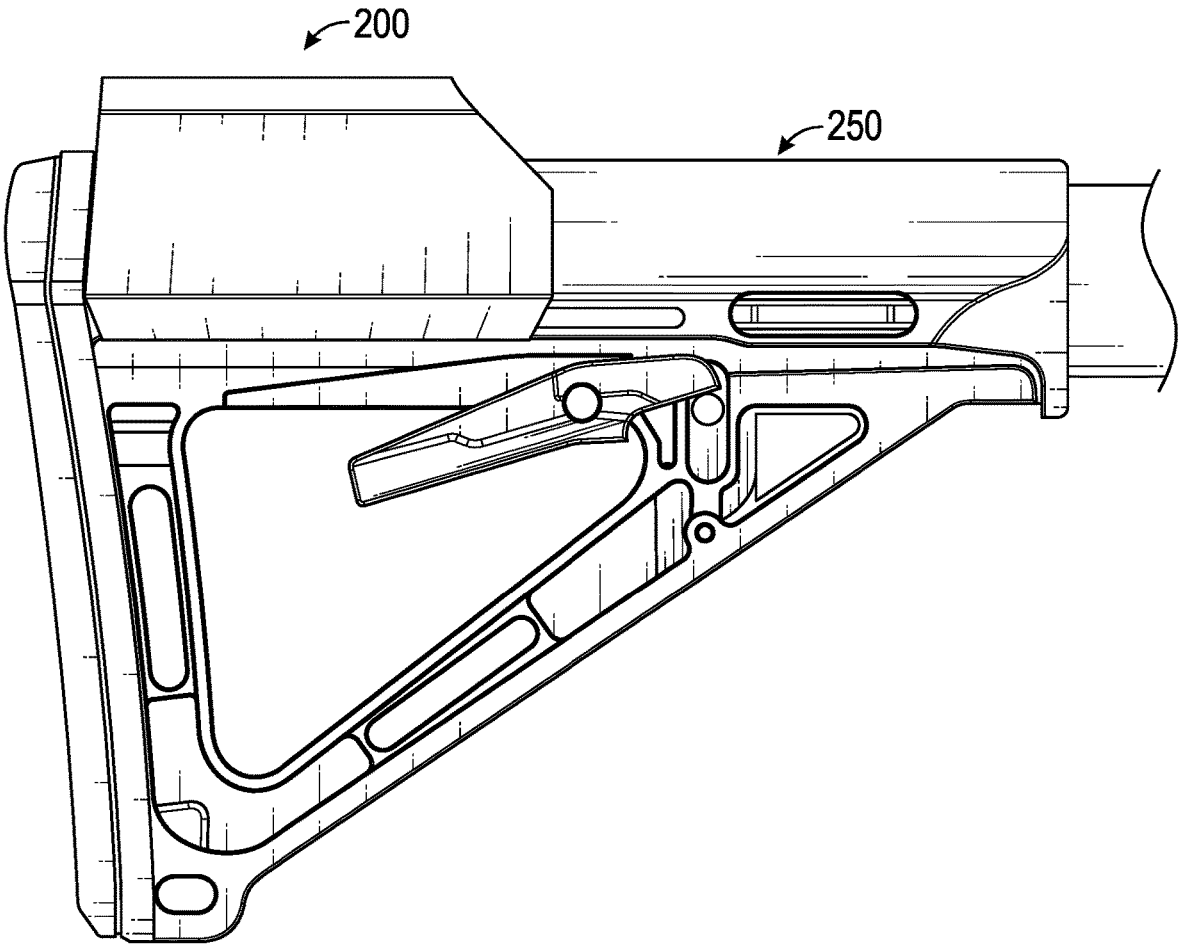
FIG. 9 is a schematic illustration of a stock cheek riser in accordance with one or more embodiments of the disclosure installed on an example stock.

The risers 10, 100 and 200 may have a length L of approximately 2.5-3.5 inches, such as 3.2 inches in one embodiment. A riser at this length, when installed on a stock 250 adjacent to the stock buttpad, as shown in FIG. 9, enables the full range of movement of the charging handle of the firearm even when the stock is in the collapsed position, yet provides sufficient surface for positioning against the user's cheek when in use.

In order to ensure the riser 10 stays on the stock during use, which may be kinetic at times, the riser 10 may be made of carbon fiber-infused nylon to provide a rigid construction that prevent the riser from becoming dislodged form the stock inadvertently.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A stock riser, comprising:

a first side wall and a second side wall, wherein the first side wall and the second side wall are opposing one another;

a hood connecting a first proximal edge of the first side wall to a second proximal edge of the second side wall, and having a rounded surface;

a longitudinal channel defined by the first side wall and the second side wall;

a first mounting protrusion on an inside surface of the first side wall;

a second mounting protrusion on an inside surface of the second side wall; and a front surface with a first portion that is substantially perpendicular to the channel, and a second portion that is angled toward a rear surface, wherein the first side wall includes a first chamfered portion at a first distal edge, and the second side wall includes a second chamfered portion at a second distal edge, wherein the first chamfered portion and the second chamfered portion are angled toward the longitudinal channel.

2. The stock riser of claim 1, wherein the first mounting protrusion is positioned opposite the chamfered portion on the inside surface of the first side wall.

3. The stock riser of claim 1, further including structural elements on an inside surface of the hood.

4. The stock riser of claim 1, wherein the hood interfaces the first side wall at an obtuse angle.

5. The stock riser of claim 1, wherein the first side wall and the second side wall angled toward each other, wherein the angle is less than 90 degrees.

6. The stock riser of claim 1, wherein the interface of the front surface and the first side wall is chamfered.

7. The stock riser of claim 1, wherein the first and second side walls and the hood are made of a material that includes carbon-fiber infused nylon.

8. The stock riser of claim 2, wherein the chamfered portion of the first side wall is angled inward toward the channel.

9. The stock riser of claim 1, wherein the first length is 3.5 inches or less.

10. The stock riser of claim 1, wherein the length limits the number of mounting protrusions on each side wall to one.

* * * * *